9/18/84 XR 4,472,457

United States Patent [19]

Craamer

[11] Patent Number: 4,472,457

[45] Date of Patent: Sep. 18, 1984

[54] PROCESS FOR TREATING PATTERN GAUZES AND/OR FIBERS TO BE USED FOR THIS WITH AT LEAST ONE BLEACHING AGENT

[75] Inventor: Johannes A. Craamer, Zollikerberg, Switzerland

[73] Assignee: Schweizerische Seidengazefabrik AG, Zurich, Switzerland

[21] Appl. No.: 525,270

[22] Filed: Aug. 23, 1983

Related U.S. Application Data

[63] Continuation of Ser. No. 306,883, Sep. 30, 1981, abandoned.

[30] Foreign Application Priority Data

Oct. 3, 1980 [CH] Switzerland ..... 7419/80

[51] Int. Cl.[3] ..... B05D 3/06

[52] U.S. Cl. ..... 427/54.1; 8/107; 8/648; 427/158

[58] Field of Search ..... 8/107, 648; 430/308, 430/295, 327; 427/54.1

[56] References Cited

U.S. PATENT DOCUMENTS

| | | | |
|---|---|---|---|
| 2,370,874 | 3/1945 | Playford | 430/308 |
| 3,255,203 | 7/1966 | Schinzel et al. | 8/107 |
| 3,839,333 | 10/1974 | Dorlars et al. | 8/648 |
| 3,907,904 | 9/1975 | Luethi | 8/648 |
| 4,076,535 | 2/1978 | Putten | 430/308 |
| 4,286,048 | 8/1981 | Merrill et al. | 430/308 |

OTHER PUBLICATIONS

Color Index, vol. 2, 3rd Ed., p. 2751.

*Primary Examiner*—Maria Parrish Tungol
*Attorney, Agent, or Firm*—Harness, Dickey & Pierce

[57] ABSTRACT

Fibers which are equipped with at least one bleaching agent are obtained in that the fibers are contacted with a dispersion or a solution containing at least one bleaching agent, said dispersion or said solution is allowed to interact to the fibers and then the so treated fibers are dried.

Preferably the fibers equipped according to the process of the invention are used as screen gauzes.

18 Claims, No Drawings

PROCESS FOR TREATING PATTERN GAUZES AND/OR FIBERS TO BE USED FOR THIS WITH AT LEAST ONE BLEACHING AGENT

This application is a continuation of application Ser. No. 306,883 filed Sept. 30, 1981, abandoned.

FIELD OF THE INVENTION

The present invention concerns a process for treating pattern gauzes or/and fibers to be used for this with at least one bleaching agent.

DESCRIPTION OF THE PRIOR ART

After having covered a pattern stretcher with a textile surface element which is used as a pattern gauze, in general the transfer of the design onto the pattern follows. The design may be transferred onto the pattern by different ways and presently the photochemical processes are preferred. In these photochemical processes usually layers—from emulsions—or films or combinations from layers and films are used. These layers consist usually of polyvinylalcohol-emulsions, which are made sensitive to light with a sensitizer, e.g. sodium- or potassium-bichromate or a diazo compound. For example, the films consist of a gelatine layer sensitive to light or of a polyvinylalcohol layer. In said layers and/or films chemical reactions are effected by the influence of light energy and these reactions may be used for effecting design patterns. The usually used layers (emulsions) and films are in general very sensitive against blue green as well as blue ultraviolet light in the range of about 390 up to 450 nanometers. By the exposure usually the emulsion and/or film cures. The photochemical processes show in general the disadvantage that the time of exposure is long. For example, the time of exposure may be from 1 to 6 minutes per 1 exposure.

For example, it is an object of the present invention to shorten said time of exposure.

SUMMARY OF THE INVENTION

Now there is provided a process for the preparation of fibers equipped with at least one bleaching agent which is characterized in contacting the fibers with a dispersion or a solution containing at least one bleaching agent allowing to interact said dispersion or said solution to the fibers and then drying the so treated fibers.

DETAILED DESCRIPTION OF THE PREFERRED EMBODIMENTS

Preferably an aqueous dispersion or an aqueous solution of the bleaching agent is used. But in general it is also possible to use a dispersion of a bleaching agent in an organic medium or an organic solvent containing the bleaching agent.

In the process of the invention the dispersion or the solution may additionally contain at least one emulsifier and/or at least one levelling agent. Furthermore, to the dispersion or the solution at least one further auxiliary product may be added.

In the process of the invention any bleaching agent—also called optical brightener—may be used. For example, these optical brighteners may also be used in the textile finishing. As examples of preferred bleaching agents the following compounds are mentioned:

Diaminostilbenedisulfonic acids,

Derivatives of the diaminostilbenedisulfonic acids such as triazoles etc., a glucoside of the 6,7-dihydroxycumarin, 7-aminocumarin, 3-phenylcumarin, diphenylpyrazoline and many bisbenzazoles.

In the process of the invention as a bleaching agent it is more preferred to use cumarin derivatives; and the most preferred compound to use is 7-aminocumarin.

In the process of the invention synthetic fibers made from polyester or nylon are preferably used. Preferred are fibers made from polyester. In general in the process of the invention natural fibers are not used. Further synthetic fibers may also be used.

The finish of the fibers may be done, for example, with the conventional extraction process or with the also known thermosol process.

In general it is not essential whether the optical brighteners are introduced on textile surface elements such as woven materials, knit goods, fleeces etc. or on not processed fibers which may be used as screen gauzes.

In the process of the invention the time of direct contact of the fibers in the dispersion or in the solution depends, for example, on the type of the fiber material. If the fibers are made from nylon, then the time of direct contact in the extraction process is in general 30 to 60 minutes; if the fibers are made from polyester, then the time of direct contact in the extraction process is usually 60 to 90 minutes.

In the process of the invention the temperature for the transfer of the optical brightener is usually not critical. The concentration of the optical brightener in the dispersion or in the solution may be 1 g/liter, but also up to 20 g/liter or 0.1% to 2% of the weight of the goods may be used. Due to the fact that the concentration depends usually also on the structure of the used optical brightener and of the substrate (e.g. polyester or polyamide), also larger or smaller concentrations than the above mentioned ranges may be used.

With the fibers equipped according to the present invention it is effected usually in the transfer of the design by means of a photochemical process that energy-rich radiation is absorbed from the excited molecules and is emitted as energy-poor radiation, i.e. as radiation with a longer wavelength.

This fluorescence emission is usually added in the blue spectral range to the normal reflection in that the total reflection is essentially stronger, so that it is more than 100%.

In other words, this means that the excited molecules absorb the ultraviolet components and the so absorbed energy is in general emitted again as blue fluorescent light.

Therewith it is effected in general that the added layers and/or films on the fibers equipped according to the process of this invention cure much faster in the transfer of the design by means of a photochemical process whereby the time of exposure may be shortened essentially. In general the reduction of time is 20 to 30% but may also be in certain cases up to 50%. Important reductions of time are effected, for example, when the fibers equipped according to the process of the invention are worked up in textile printing with an "adding and copying machine" or a "step and repeat machine", both known to somebody skilled in the art.

Preferably the fibers equipped according to the process of the invention are used as screen gauzes.

The following example may illustrate the present invention:

| | |
|---|---|
| Polyester gauze fabric | |
| number of threads per cm: | 120 |
| thread diameter: | 33 micrometer |
| loop opening: | 51 micrometer |
| open area: | 37% |
| fabric thickness: | 65 micrometer |
| fabric weight: | 35 g/m$^2$ |
| Treatment | |
| 20 g/l | a heterocyclic cumarin derivative (trade name e.g. Blankophor ERL liquid of BAYER) |
| padding | 30 seconds at a temperature |
| drying | of 190° C. |
| thermosoling | |
| Coating | |
| 1 × outside | |
| 1 × inside | |
| drying | |
| 1 × outside | |
| drying | |
| with a PVA-emulsion (trade name e.g. ULANO Coat 569 of Ulano) | |
| Exposure | |
| metal halogen lamp | 5000 Watt |
| distance | 1 meter |
| exposure | 90 units (= about 90 seconds) |

The same exposure of an untreated pattern gauze of the same type would afford 120 units of exposure to effect the same curing of the emulsion.

What is claimed is:

1. A process for treating a pattern gauze comprising contacting a pattern gauze with a composition containing at least one optical brightener, allowing said optical brightener to interact with the pattern gauze, then drying the pattern gauze, applying at least one light sensitive coating to said pattern gauze, and then exposing portions of said coating on said pattern gauze to light.

2. The process of claim 1, wherein said composition comprises at least one emulsifier.

3. The process of claim 1, wherein said composition comprises at least one leveling agent.

4. The process of claim 1, wherein said pattern gauze comprises polyester fibers.

5. The process of claim 1, wherein said composition is selected from the group consisting of an aqueous dispersion of said optical brightener and an aqueous solution of said optical brightener.

6. The process of claim 1, wherein said pattern gauze comprises polyamide fibers.

7. The process of claim 1, wherein said pattern gauze comprises nylon fibers.

8. A process for shortening the time of exposure in the photochemical transfer of designs to light sensitive films which are applied on pattern gauzes, comprising the steps of contacting the pattern gauzes with a solution containing at least one optical brightener, allowing said solution to interact on said pattern gauzes, drying the treated pattern gauzes, applying at least one of said light sensitive films to said pattern gauzes, and exposing at least portions of said pattern gauzes and at least one of said light sensitive films to light to transfer designs wherein the portions exposed to light are cured.

9. The process of claim 8, wherein said composition contains additionally at least one emulsifier.

10. The process of claim 9, wherein said composition contains additionally at least one levelling agent.

11. The process of claim 8, wherein the optical brightener is a cumarin derivative.

12. The process of claim 11, wherein the optical brightener is derived from 7-aminocumarin.

13. The process of claim 8, wherein said pattern gauze comprises polyester.

14. The process of claim 8, wherein said composition is an aqueous dispersion.

15. The process of claim 8, wherein said pattern gauze comprises polyamide fibers.

16. The process of claim 15, wherein said pattern gauze comprises nylon fibers.

17. A process for shortening the time of exposure in the photochemical transfer of designs to a light sensitive coating on pattern gauzes, comprising contacting a pattern gauze with a composition containing at least one optical brightener wherein said optical brightener is a derivative of cumarin, applying at least one light sensitive coating to said pattern gauze, and then exposing portions of said coating on said pattern gauze to light.

18. The process of claim 17, wherein said optical brightener is 7-aminocumarin.

* * * * *